United States Patent [19]

Komatsu et al.

[11] Patent Number: 4,904,580

[45] Date of Patent: Feb. 27, 1990

[54] SILVER HALIDE PHOTOGRAPHIC LIGHT-SENSITIVE MATERIAL

[75] Inventors: Hajime Komatsu; Susumu Ohkawachi; Fujitsugu Suzuki, all of Odawara, Japan

[73] Assignee: Konishiroku Photo Industry Co., Ind., Tokyo, Japan

[21] Appl. No.: 181,970

[22] Filed: Apr. 15, 1988

Related U.S. Application Data

[63] Continuation of Ser. No. 840,522, Mar. 13, 1986, abandoned, which is a continuation of Ser. No. 652,830, Sep. 20, 1984, abandoned.

[30] Foreign Application Priority Data

Sep. 22, 1983 [JP] Japan ..... 58-175522

[51] Int. Cl.[4] ..... G03C 1/485

[52] U.S. Cl. ..... 430/567; 430/569; 430/940

[58] Field of Search ..... 430/409, 599, 940, 567, 430/569

[56] References Cited

FOREIGN PATENT DOCUMENTS 1027146 4/1966 United Kingdom .

*Primary Examiner*—Paul R. Michl
*Assistant Examiner*—Janet C. Baxter
*Attorney, Agent, or Firm*—Jordan B. Bierman

[57] ABSTRACT

A direct positive silver halide photographic light sensitive material including a support having thereon at least one silver halide emulsion layer containing internal latent image silver halide grains, each of the grains comprising a core/shell structured particle comprising a core, at least one intermediate layer, and an outermost layer formed thereon. The outermost layer consists essentially of silver chloride which accounts for no more than 10 mol % of the silver halide in the internal latent image silver halide grain. Such photographic materials display an increased sensitivity while maintaining an adequate image density.

12 Claims, No Drawings

SILVER HALIDE PHOTOGRAPHIC LIGHT-SENSITIVE MATERIAL

PRIOR APPLICATION

This application is a continuation of U.S. patent application Ser. No. 840,522 filed Mar. 13, 1986 which is a continuation of U.S. patent application Ser. No. 652,830 filed Sept. 20, 1984, both now abandoned.

BACKGROUND OF THE INVENTION

1. Field of the Invention

The present invention relates to a direct-positive photographic image-forming internal latent image-type silver halide photographic light-sensitive material, and more particularly to an internal latent image-type layered-grain-structure silver halide photographic light-sensitive material having a high speed, high maximum density and low minimum density, and excellent storability and preservability for long periods of time.

2. Description of the Prior Art

There have heretofore been known various positive-type silver halide light-sensitive materials. Of these, non-surface-fogged, internal latent image-type silver halide light-sensitive materials, generally, are highly sensitive as compared to those light-sensitive materials of the prefogged silver halide emulsion type producing a positive image by destroying the fog nucleus (latent image) of an exposed area, utilizing the solarization or Herschel effect. Emulsions containing non-surface fog grains therefore advantageously usable in the direct positive-type light-sensitive material that needs to be highly sensitive.

The internal latent image-type direct-positive light-sensitive material, after being exposed imagewise, is subjected to surface development after or with fogging treatment, whereby a direct positive image can be obtained.

The mechanism of the formation of this direct-positive image, although still not clarified in detail, may be understood to a certain extent by making reference to, e.g., Mees and James, "The Theory of the Photographic Process," 3rd ed., p. 161 ("Desensitization by Internal Latent Images"), and the like.

There are many types of silver halide emulsions known as the internal latent image-type silver halide emulsion, which include those conversion emulsions as described in U.S. Pat. No. 2,592,250; those metallic ion doping emulsions or internal-chemically-sensitized layered-grain-structure-type emulsions as described in U.S. Pat. No. 3,206,313; Japanese Patent Examined Publication Nos. 29405/1968, 29012/1976; U.S. Pat. Nos. 3,317,322, 3,447,927, 3,531,291, 3,703,584, 3,761,266, 3,761,267 and 3,761,276; those emulsions in which silver chloride and silver bromide are deposited in the layered-grain-structure form as described in Japanese Patent Open to Public Inspection (hereinafter referred to as Japanese Patent O.P.I. Publication) Nos. 8524/1975 and 38525/1975; and those layered-grain-structure-type emulsions which use conversion emulsions as the core thereof as described in Japanese Patent O.P.I. Publication No. 127549/1980.

In these silver halide emulsions, generally, the core of the silver halide internally sensitized by chemical sensitization, metallic ion doping, conversion, or the like, is coated with a shell, and the surface of the silver halide particle, if necessary, is slightly sensitized.

However, it has now been found that the thus obtained emulsion leaves some problems to be solved with respect to the stability over the course of time.

Upon this, the stability in the course of time can be increased by, for example, increasing the thickness of the shell. On the other hand, however, the increase in the thickness is disadvantageous in respect that it results in the decrease in the maximum density or it deteriorates the developability. Chemically sensitized nuclei produced by chemically sensitizing the surface of silver halide particles, although capable of improving the problems of the developability and maximum density, tends to adversely affect the problems of the negative's speed and minimum density, so that the nucleus needs to be produced under correctly controlled conditions. And it is poor in the stability for storage for long periods; during which it increases the minimum density or deteriorates the maximum density of the resulting positive image. Therefore, in order to make practical use of emulsions of this kind in various photographic fields, the improvement on the photographic characteristics; i.e., the improvement on the sensitivity, decrease in the minimum density (Dmin), increase in the maximum density (Dmax), and besides, the improvement on the storability or preservability in the course of time are required.

Many attempts have been made to improve the storability with time of the internal latent image-type emulsion. For example; Japanese Patent O.P.I. Publication Nos. 138820/1975 and 21067/1980 disclose the use of mercapto-type compounds; No. 54437/1981 discloses the use of indazole compounds; No. 138631/1982 describes the use of polyvinylpyrolidones; and No. 66727/1978 describes the use of oxidizing agent compounds such as red prussiates. Further, Japanese Patent O.P.I. Publication No. 136641/1982 discloses the use of polyvinylpyrolidones at the time of the chemical ripening of the silver halide particle surface.

These compounds, however, should be used in a large quantity in order to exhibit their effect, and, if used that way, cause remarkable desensitization and deterioration of the density due to their development inhibiting effect. These compounds, therefore, are not considered suitable for practical use.

SUMMARY OF THE INVENTION

It is, therefore, an object of the present invention to provide an internal latent image-type silver halide photographic light-sensitive material which has a high sensitivity, high maximum density (Dmax) as of its reversal image, and low minimum density (Dmin).

It is another object of the present invention to provide an internal latent image-type silver halide photographic light-sensitive material which has a high-sensitivity and excellent stability for long periods of time.

It is still another object of the present invention to provide an internal latent image-type silver halide photographic light-sensitive material which has an excellent stability in development and high maximum density.

The above objects of the present invention are accomplished by a silver halide photographic light-sensitive material comprising a support having thereon at least one silver halide emulsion layer containing internal latent image-type layered-grain-structure silver halide particles, the silver halide particles each having the outermost layer of a substantially single silver halide composition of not more than 10 mole % to the silver halide that constitutes the particle, and the internal of the particle is layered further than the outermost layer.

DETAILED DESCRIPTION OF THE INVENTION

The internal latent image-type silver halide particle which constitutes the emulsion used in the present invention is of a layered-grain structure from the outermost layer through the inside, and the core portion is prepared by being subjected to doping with metallic ions, chemical sensitization, conversion or a combination of these treatments. Doping a metallic ion on the above core is made, for example, in the manner that the core, in the course of the silver halide particle formation or physical ripening thereof, is rendered present together with metallic ions of a salt such as a cadmium salt, lead salt, iridium salt, zinc salt, thalium salt, or a complex salt of these salts. The chemical sensitization of the above core may be carried out by using alone or in combination of two or more of known noble-metallic sensitizers, sulfur sensitizers, reduction sensitizers, and the like. The core may also be subjected to conversion treatment to adjust the internal sensitivity. Further, a combination of these treatments increases sensitivity.

The core that has been prepared as described above is coated with a shell, and then, if necessary, subjected to chemical treatments such as chemical sensitization. The method for coating the core with a silver halide as the shell is of the prior art, and can be carried out by making reference to, e.g., U.S. Pat. Nos. 3,206,313, 3,317,322, 3,367,778, and the like.

The chemical sensitization of the shell surface may be performed by any of the prior-art sensitization methods; the sulfur sensitization method which uses sulfur-containing compounds, the reduction sensitization method using reducing materials, the noble-metallic sensitization method using gold compounds or other noble-metallic compounds, and the like; these methods may be used alone or in combination. However, the chemical sensitization, if unnecessary, need not be performed.

The present invention is intended to largely improve an internal latent image-type emulsion by way of covering the surface of the thus obtained internal latent image-type silver halide grain with a thin layer, the finally coated outermost layer, comprising silver halide particles, and not to impair the intrinsic characteristics of the internal latent image-type emulsion.

The silver halide composition layered as the outermost layer is a substantially single silver halide composition, preferably composed substantially of silver bromide or silver chloride, and most preferably composed of silver chloride from the developability point of view. The proportion of the silver halide to be layered as the outermost layer to the whole of the silver halide particles of the present invention, although it depends on the silver halide particle size, is not more than 10 mole % to the whole of the silver halide. If it exceeds the limit, it affects the developability, and the like, making it difficult to obtain a satisfactory positive image. If the quantity of the silver halide in the outermost layer is too small, it will exhibit no adequate effect. For this reason, the silver halide is desired to be used in the range of from 0.5 to 7 mole %, more preferably 3 to 7 mole %. There is no need of coating the outermost layer completely. Even partial coating of it can exhibit its effect satisfactorily.

As the method for the coating of the silver halide as the outermost layer those methods for use in preparing the foregoing core/shell emulsion may be used. However, the method for the coating of the outermost layer need not be the same as that used in the coating of the inner part.

The outermost layer of the present invention is usually not subjected to chemical ripening, but may be subjected to it, if necessary.

The thus obtained silver halide particles of the present invention, needless to say, have the characteristics required for the internal latent image-type emulsion.

The characteristics required for the internal latent image-type emulsion is such that the maximum density obtained when exposing for not more than one second with a light-intensity scale and developing a sample prepared by coating the emulsion on a transparent support in a substantially silver halide solvent-free Surface Developer Solution [A] of the following composition for 4 minutes at 20° C. is not more than 1/5 of the maximum density obtained when the same emulsion sample exposed in the same manner in the following Internal Developer [B] for developing the particle's internal latent image for 4 minutes at 20° C. More preferably, the maximum density obtained by use of Surface Developer [A] is not more than 1/10 of that obtained by use of Internal Developer [B].

| | |
|---|---|
| Surface Developer [A]: | |
| Metol | 2.5 g |
| L-ascorbic acid | 10.0 g |
| $NaBO_2.4H_2O$ | 35.0 g |
| KBr | 1.0 g |
| Water to make | 1 liter |
| Internal Developer [B]: | |
| Metol | 2.0 g |
| Anhydrous sodium sulfite | 90.0 g |
| Hydroquinone | 8.0 g |
| Sodium carbonate, monohydrated | 52.5 g |
| KBr | 5.0 g |
| KI | 0.5 g |
| Water to make | 1 liter |

The internal latent image-type silver halide emulsion may contain photographic additives arbitrarily. For example, those optical sensitizers usable in this invention include cyanines, merocyanines, 3- or 4-neucleus merocyanines, 3- or 4-nucleus cyanines, styryls, holopolacyanines, hemicyanines, oxonoles, hemioxonoles. The preferred of these optical sensitizers are those nitrogen-containing heterocyclic nuclei containing as part of the structure thereof a basic group such as of thiazoline or thiazole or a nucleus such as of rhodanine, thiohydantoin, oxazolidinedione, barbituric acid, thiobarbituric acid, pyrazolone, and the like. The nucleus may have a substituent such as an alkyl, hydroxyalkyl, sulfoalkyl, carboxyalkyl, halogen, phenyl, cyano, or alkoxy group, and may be arbitrarily condenced with a carbon ring or heterocyclic ring.

The internal latent image-type silver halide emulsion of the present invention may be supersensitized. The method of supersensitization is described in, e.g., the "Review of Supersensitization" of the "Photographic Science and Engineering" (PSE) Vol. 18, p. 4418 (1974).

The emulsion of the present invention may contain a stabilizer that is usually used to restrain the surface sensitivity as low as possible as well as to provide a lower minimum density and stabler characteristics; for example, azaindene ring-having compounds and mercapto group-having heterocyclic ring-type compounds.

The preferred azaindene ring-having compound is 4-hydroxy-6-methyl-1,3,3*a*,7-tetrazaindene. The preferred mercapto group-having nitrogen-containing heterocyclic compound includes pyrazole ring, 1,2,4-triazole ring, 1,2,4-triazole ring, 1,3,4-thiadiazole ring, 1,2,3-thiadiazole ring, 1,2,4-thiadiazole ring, 1,2,5-thiadiazole ring, 1,2,3,4-tetrazole ring, pyridazine ring, 1,2,3-triazine ring, 1,2,4-triazine ring, 1,3,5-triazine ring; a ring formed by the condensation of two or three of these rings, such as, e.g., triazolotriazole ring, diazaindene ring, triazaindene ring, tetrazaindene ring, pentazaindene ring, etc.; and phthalazinone ring, indazole ring, and the like. The preferred one among them is 1-phenyl-5-mercaptotetrazole.

In addition, a lubricant that may be used at need in the present invention including, for example, dihydroxyalkanes, etc. A layer's hysical property-improving agent that may be suitably used in the invention includes water-dispersible fine-grained high-molecular materials obtained by emulsion polymerization, such as alkyl acrylate or methacrylate-acrylic or methacrylic acid copolymers, styrene-maleic acid copolymers, styrene-maleic anhydride half-alkyl ester copolymers, etc. A coating aid usable in this invention includes saponin, polyethylene glycol, lauryl ether, and the like. Other photographic additives include gelatin plasticizers, surface active agents, ultraviolet absorbing agents, pH adjusting agents, oxidation inhibitors, antisatic agents, viscosity increasing agents, graininess improving agents, dyes, mordants, brighteners, developing rate control agents, matting agents, antiirradiation dyes, and the like. These additives may be arbitrarily used in the invention.

The silver halide emulsion of this invention, if used for making a color photographic material, should contain dye-forming couplers.

As an yellow dye forming coupler, benzoylacetanilide-type or pivaloylacetanilide-type couplers, or two-equivalent-type yellow couplers, whose coupling position's carbon atom is substituted by a split-off radical that can be split off at the time of the coupling reaction, are useful.

As a magenta dye forming coupler, 5-pyrazolone-type, pyrazolotriazole-type, pyrazolinobenzimidazole-type or indazolone-type couplers, or split-off radical-having two-equivalent-type magenta couplers are useful. As a cyan dye forming coupler, phenol-type naphthol-type are useful. These dye forming couplers may be selected arbitrarily, and no particular restrictions are placed on the use and quantity of these couplers.

The photographic emulsion of this invention may also be used in combination with a diffusion transfer dye-providable material to be subjected to an appropriate development to thereby form a desired transfer image on an image-receiving material. As the diffusion transfer dye-providable material there may be used those as described in, for example, U.S. Pat. Nos. 3,227,551, 3,227,554, 3,443,939, 3,443,940, 3,658,824, 3,698,897, 3,725,062, 3,728,113, 3,751,406; British Pat. Nos. 840,781, 904,364, 1,038,331; West German OLS Patent Nos. 1,930,215, 2,214,381, 2,228,361, 2,242,762, 2,317,134, 2,402,900, 2,406,626, 2,406,653; Japanese Patent O.P.I. Publication No. 114424/1974, and the like.

Any of ultraviolet absorbing agents including thiazolidone-type, benzotriazole-type, acrylonitrile-type, benzophenon-type compounds may be useful for preventing the dye image from possible discoloration by short-wavelength active rays.

The silver halide photographic light-sensitive material of the present invention may contain gelatin or an appropriate gelatin derivative according to the purpose for which the light-sensitive material is used. The appropriate gelatin derivative includes acylated gelatin, guanidylated gelatin, carbamylated gelatin, cyanoethanolated gelatin, esterified gelatin, and the like.

The hydrophilic colloidal layer of gelatin or these gelatin derivatives may also contain different other hydrophilic binder materials. Those appropriate as the binder include, aside from the foregoing gelatin or gelatin derivatives, colloidal albumin, agar-agar, gum arabic, dextran, alginic acid; cellulose derivatives such as cellulose acetate hydrolyzed to an acetyl-containing percentage of 10 to 20%; polyacrylamides, imidated polyacrylamides, casein; urethanecarboxylic acid group-or cyanoacetyl group-containing vinyl alcohol polymers such as vinyl alcohol-vinylaminoacetate copolymer; polyvinyl alcohols, polyvinyl pyrolidones, hydrolyzed polyvinyl acetates; polymers obtained by the polymerization of proteins or saturated acylated proteins with vinyl group-having monomers; polyvinyl pyridines polyvinylamines, polyaminoethyl methacrylates, polyethyleneamines, and the like. Any of these binder materials may be used for the silver halide photographic light-sensitive material component layers such as emulsion layers, interlayers, protective layer, filter layers, backing layer, and the like, according to the purpose for which the light-sensitive material is used. Further, into the above hydrophilic binder an appropriate plasticizer or lubricant may be incorporated, if necessary.

The component layers of the silver halide photographic light-sensitive material of the present invention may be hardened by use of an appropriate hardening agent. Hardening agents usable in the invention include chromium salts, zirconium salts, aldehyde-type compounds such as formaldehyde or mucohalogenic acid, halotriazine-type compounds, polyepoxy compounds, ethyleneimine-type compounds, vinylsulfone-type compounds, acryloyl-type hardeners, and the like.

The silver halide photographic light-sensitive material of the present invention is prepared by coating on a support various photographic component layers such as emulsion layers, filter layers, interlayers, protective layer, subbing layer, backing layer, antihalation layer, and the like.

The silver halide photographic light-sensitive material of the present invention may be effectively applied to various uses such as for black-and-white photography, radiography, color photography, false color photography, graphic arts, infrared photography, micrographics, and the like, and may also be applied to the color image transfer process, color diffusion transfer process, absorption transfer process, etc., as described in U.S. Pat. Nos. 3,087,817, 3,185,567 and 2,983,606 of Rogers, U.S. Pat. Nos. 3,253,915, 3,227,550, 3,227,551, 3,227,552, 3,415,644, 3,415,645 and 3,415,646.

Any arbitrary materials may be used as the support for coating thereon the photographic emulsion of this invention. Typical examples of the support material are subbed polyethylene terephthalate film, polycarbonate film, polystyrene film, polypropylene film, cellulose acetate film, glass plates, baryta paper, paper laminated with a polyolefin such as polyethylene, and the like.

In the photographic light-sensitive material of the present invention, the principal process for forming a direct positive image comprises the imagewise exposure and surface development, after or with fogging treatment, of an internal latent image-type silver halide light-sensitive material whose particle surface is unfogged, the said fogging treatment being carried out either by solid exposure or by use of a fogging agent. The solid exposure is desirable to be performed in the manner that the imagewise exposed light-sensitive material is immersed in or wetted by a developer solution or an aqueous solution, and then subjected to a solid, uniform exposure. As the light source for use in this exposure any kind of light may be used as long as it matches spectrally with the wavelength region to which the light-sensitive material is sensitive. The light used is allowed to be either a high-intensity, momentarily-emitting light like an electronic flash or a low-intensity, long-period-emitting light. The solid exposure time should be varied so as to give finally the best positive image according to the light-sensitive material, developing condition and kind of the light used. As the fogging agent a large variety of compounds may be used. The fogging agent can be present anywhere during the development of the light-sensitive material; for example, the agent is allowed in the silver halide emulsion layer of the internal latent image-type photographic light-sensitive material, in a developer liquid, or in a pretreatment liquid prior to the development, preferably in the silver halide photographic light-sensitive material, and most preferably in the emulsion layer containing the silver halide particles of the present invention. The using quantity of the fogging agent can be varied according to purposes. The preferred adding quantity to the silver halide emulsion layer is from 1 to 1500 mg, and most preferably from 10 to 1000 mg per mole of the silver halide. When the agent is to be added to a processing liquid such as a developer, the preferred adding quantity is from 0.01 to 5 g per liter, and most preferably from 0.08 to 0.15 g per liter. Such fogging agents include those hydrazines described in U.S. Pat. Nos. 2,563,785 and 2,588,982; those hydrazide or hydrazone compounds described in U.S. Pat. No. 3,227,552; those heterocyclic quaternaly nitrogen salt compounds described in U.S. Pat. Nos. 3,615,651, 3,718,470, 3,719,494, 3,734,738 and 3,759,901; and those acylhydrozinophenylthioureas described in U.S. Pat. No. 4,030,925. These fogging agents may be used in combination. For example, Research Disclosure 15162 describes the combined use of a non-adsorption-type fogging agent with an adsorption-type fogging agent.

Useful examples of the fogging agent are hydrazine compounds such as hydrazine hydrochloride, phenylhydrazine hydrochloride, 4-methylphenylhydrazine hydrochloride, 1-formyl-2-(4-methylphenyl)hydrazine, 1-acetyl-2-phenylhydrazine, 1-acetyl-2-(4-acetamidophenyl)hydrazine, 1-methylsulfonyl-2-phenylhydrazine, 1-benzoyl-2-phenylhydrazine, 1-methylsulfonyl-2-(3-phenylsulfonamidophenyl)hydrazine, formaldehydophenylhydrazine, and the like; N-substituted quaternary cycloammonium salts such as 3-(2-formylethyl)-2-methylbenzothiazolium bromide, 3-(2-formylethyl)-2-propylbenzothiazolium bromide, 3-(2-acetylethyl)-2-benzylbenzoselenazolium bromide, 3-(2-acetylethyl)-2-benzyl-5-phenyl-benzoxazolium bromide, 2-methyl-3-[3-(phenylhydrazono)propyl]benzothiazolium bromide, 2-methyl-3-[3-(p-tolylhydrazono)propyl]benzothiazolium bromide, 2-methyl-3-[3-(p-sulfophenylhydrazono)propyl]benzothiazolium bromide, 2-methyl-3-[3-(p-sulfophenylhydrazono)benzyl]benzothiazolium iodide, 1,2-dihydro-3-methyl-4-phenylpyrido[2,1-b]benzothiazolium bromide, 1,2-dihydro-3-methyl-4-phenylpyrido[2,1-b]-5-phenylbenzoxazolium bromide, 4,4-ethylene-bis(1,2-dihydro-3-methylpyrido[2,1-b]benzothiazolium bromide, 1,2-dihydro-3-methyl-4-phenylpyrido[2,1-b]benzoselenazolium bromide, and the like; 5-[1-ethylnaphtho(1,2-b)thiazoline-2-ylidenethyliden]-1-(2-phenylcarbazoyl)methyl-3-(4-sulfamoylphenyl)-2-thiohydantoin, 5-(3-ethyl-2-benzothiazolinidene)-3-[4-(2-formylhydrazino)phenyl]rhodanine, 1-[4-(2-formylhydrazino)phenyl]3-phenylthiourea, 1,3-bis[4-(2-formylhydrazino)phenyl]thiourea, and the like.

The internal latent image-type photographic light-sensitive material of the present invention is exposed imagewise, and then developed with a solid exposure or in the presence of a fogging agent to thereby form a direct position image. This development of the light-sensitive material may be carried out by an arbitrary developing method, and desired to be made by the surface developing method. This surface development implies that the light-sensitive material is processed in a developer solution that contains substantially no silver halide solvent.

Silver halide developing agents usually usable in the above developer solution include polyhydroxybenzenes such as hydroquinone, aminophenols, 3-pyrazolidones, ascorbic acid and its derivatives, reductones, phenylenediamines, etc., and mixtures of these compounds. Particular examples of such agents are hydroquinon, aminophenol, N-methylaminophenol, 1-phenyl-3-pyrazolidone, 1-phenyl-4,4-dimethyl-3-pyrazolidone, 1-phenyl-4-methyl-4-hydroxymethyl-3-pyrazolidone, ascorbic acid, N,N-diethyl-p-phenylenediamine, diethylamino-o-toluidine, 4-amino-3-methyl-N-ethyl-N-(β-methanesulfonamidoethyl)aniline, 4-amino-3-methyl-N-ethyl-N-(β-hydroxyethyl)aniline, and the like. One or some of these developing agents may be incorporated in advance into the emulsion layer so that the agent, when the emulsion layer is immersed in a high-pH aqueous solution, acts upon the silver halide.

The above-mentioned developer solution may contain further an antifogging agent and development accelerator. These additives to the developer solution may also be incorporated arbitrarily into a layer of the silver halide photographic emulsion. In general, useful antifogging agents include benzotriazoles such as 5-methylbenzotriazole; benzothiazoles; heterocyclic thions such as 1-phenyl-5-mercaptotetrazole; aromatic and aliphatic mercapto compounds, and the like. The developer solution may also contain development accelerators such as polyalkyleneoxid derivatives, quaternary ammonium salt compounds, and the like.

EXAMPLES OF THE INVENTION

The present invention will be illustrated further by the following examples, but is not limited thereto.

The sensitometric conditions that were used in the present invention are as follows:

Exposure

Exposure was made through an optical step wedge with a density step differential of 1.0 in a sensitometer Model KS-7 (manufactured by Konishiroku Photo Industry Co., Ltd.).

Processing Steps

| | | |
|---|---|---|
| Developing | at 30° C. | for 3 minutes |

(Fifteen minutes after starting development, the entire area of a sample was exposed uniformly for 5 seconds to 5-lux light)

| | | |
|---|---|---|
| Bleach-fixing | at 30° C. | for 2 minutes |
| Washing | at 20–30° C. | for 2 minutes |
| Drying | at room temperature | for 30 minutes |

Compositions of the Processing Liquids Used

| | |
|---|---|
| Developer: | |
| 4-amino-3-methyl-N—ethyl-N—(β-methanesulfonamidoethyl)aniline sulfate | 5 g |
| Anhydrous sodium sulfite | 2 g |
| Sodium carbonate, monohydrated | 15 g |
| Potassium bromide | 1 g |
| 5-methylbenzotriazole-benzyl alcohol | 10 g |
| Water to make 1 liter. Use potassium hydroxide to adjust the pH to 10.2. | |
| Bleach-fixer: | |
| Ferric ammonium ethylenediamine-tetracetate, dihydrated | 50 g |
| Ethylenediamine-tetracetate | 3 g |
| Ammonium thiosulfate(70% aqueous solution) | 100 ml |
| Potassium sulfite(50% aqueous solution) | 40 ml |
| Bisthiourea | 0.1 g |
| Water to make 1 liter. Use potassium carbonate or acetic acid to adjust the pH to 6.5. | |

Measurement

A SAKURA Photographic Densitometer PDA-65 (manufactured by Konishiroku Photo Industry Co., Ltd.) was used to measure the transmission density and reflection density of each sample on condition that the zero-point in measurement, for transmission density, was adjusted to where no sample was present, and, for reflection density, was adjusted to the reflection density of the surface of the support before being emulsion-coated.

Characteristics (1) Maximum density (Dmax): The maximum density of a shadow area
(2) Minimum density (Dmin): The minimum density of a highlight area
(3) Speed: The reciprocal of an exposure necessary to provide the density of (Dmax+Dmin)/2 was found, which was indicated with respect to each sample of the respective examples in terms of a relative speed to the speed of each comparative sample regarded as 100.

EXAMPLE 1

At an emulsifying-ripening temperature controlled to 60° C., to an aqueous solution containing 50 g of gelatin were added in the pouring manner 875 ml of an aqueous 2.0 mole-concentration silver nitrate solution and 875 ml of an aqueous 2.1 mole-concentration sodium chloride solution simultaneously spending about 20 minutes to prepare an emulsified mixture liquid. After being subjected to 10-minute ripening, to the mixture were added in the pouring manner 1000 ml of an aqueous 2.0 mole-concentration potassium bromide solution and 9 ml of an aqueous 0.5 mole-concentration potassium iodide solution, spending about 2 minutes, and further 10-minute ripening took place. After that, the temperature was lowered to 40° C., and the water-soluble salts were removed from the mixture by the precipitation-washing method. Water was added to the mixture to make the whole 2500 ml. At a temperature controlled to 50° C. 600 ml of an aqueous 1.0 mole-concentration silver nitrate solution and 625 ml of an aqueous 1.0 mole-concentration potassium bromide solution simultaneously was then added. After about 5 minutes this mixture was subjected to 15-minute ripening. The water-soluble salts were removed from the mixture by the precipitation-washing method. An aqueous gelatin solution was added to this, and then redispersion of it took place. After that, the whole quantity was made 2000 ml. The resulting emulsion was divided into five parts, which were then subjected to the following treatments, respectively.

Emulsion (A): Untreated (Comparative Sample)

Emulsion (B) (Noninvention): 1.05 mg of sodium thiosulfate per mole of silver were added, and the emulsion was ripened for 20 minutes at 60° C. to chemically sensitize the particle surface.

Emulsion (C) (Invention): After being chemically sensitized in the same manner as in Emulsion (B), to this emulsion were added in the simultaneous pouring manner at a temperature controlled to 60° C. 33 ml of an aqueous 1.0 mole-concentration silver nitrate solution and 37 ml of an aqueous sodium chloride solution, spending about 2 minutes. After that, 15-minute ripening took place. The silver chloride of the outermost layer accounts for 6.6 mole % of the whole of the particles.

Emulsion (D) (Noninvention): 1.05 mg of sodium thiosulfate per mole of silver were added, and the emulsion was ripened for 40 minutes at 60° C. to chemically sensitize the particle surface of the emulsion.

Emulsion (E) (Invention): After being chemically sensitized in the same manner as in Emulsion (D), to this emulsion were added in the simultaneous pouring manner at a temperature controlled to 60° C. 33 ml of an aqueous 1.0 mole-concentration silver nitrate solution and 37 ml of an aqueous sodium chloride solution, spending about 2 minutes. After that, 15-minute ripening took place. The silver chloride of the outermost layer accounts for 6.6 mole % of the whole particles.

To each of the above emulsions were added 70 mg per mole of silver of the following Sensitizing Dye (I), and further added the following composition-having Yellow Coupler Liquid (I) and the following Hardening Agents (I) and (II). The thus prepared emulsion was coated on a subbed polyester film support so that the silver coating amount is 2.0 g/m$^2$, and then dried.

Sensitizing Dye (I)

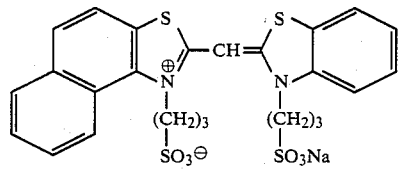

Yellow Coupler Liquid (I)

α-[4-(1-benzyl-2-phenyl-3,5-dioxo-1,2,4-tri- 145 g

-continued

| | |
|---|---|
| azolidinyl)]-α-pivalyl-2-chloro-5-[γ-(2,4-di-tert-amylphenoxy)butylamido]acetanilide | |
| 2,5-di-tert-octylhydroquinone | 1.5 g |
| 2,5-di-tert-butylhydroquinone | 1.5 g |

The above compounds were dissolved into a mixture solvent of ethyl acetate and dibutyl phthalate. This solution was mixed with a gelatin solution containing sodium dodecylbenzenesulfonate, and then the ultrasonic dispersion of it took place.

Hardening Agent (I)

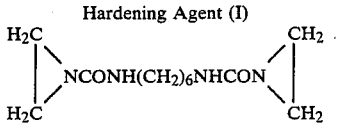

Hardening Agent (II)

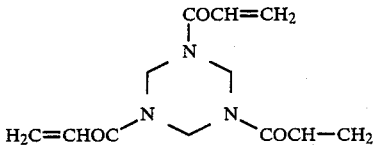

Each of these samples was subjected to the following treatment: Each sample was divided into three pieces; one was stored for 24 hours under the atmospheric condition of a temperature of 20° C. with a relative humidity of 55% (regarded as Condition 1); another was aged for three days under the condition of a temperature of 55° C. with a relative humidity of 10% (regarded as Condition 2); and the other for three days under the condition of a temperature of 55° C. with a relative humidity of 80% (regarded as Condition 3). After that, each piece was processed and then subjected to a sensitometeric test under the conditions specified previously. The obtained results are as give in Table 1.

TABLE 1

| Sample No. | Emulsion | Photographic characteristics | Condition 1 | Condition 2 | Condition 3 |
|---|---|---|---|---|---|
| 1 | Emulsion (A) (comparative) | Relative speed | 100 | 82 | 96 |
| | | Maximum density | 1.24 | 1.63 | 1.32 |
| | | Minimum density | 0.12 | 0.24 | 0.19 |
| 2 | Emulsion (B) (Noninvention) | Relative speed | 84 | 48 | 64 |
| | | Maximum density | 2.00 | 2.32 | 2.08 |
| | | Minimum density | 0.28 | 0.49 | 0.36 |
| 3 | Emulsion (C) (Invention) | Relative speed | 124 | 112 | 120 |
| | | Maximum density | 2.02 | 2.13 | 1.98 |
| | | Minimum density | 0.09 | 0.16 | 0.14 |
| 4 | Emulsion (D) (Noninvention) | Relative speed | 76 | 24 | 52 |
| | | Maximum density | 2.18 | 2.42 | 2.22 |
| | | Minimum density | 0.38 | 0.64 | 0.47 |
| 5 | Emulsion (E) (Invention) | Relative speed | 118 | 108 | 112 |
| | | Maximum density | 2.09 | 2.16 | 2.04 |
| | | Minimum density | 0.12 | 0.19 | 0.17 |

As is apparent from Table 1, the samples of this invention (Emulsions (C) and (E)) have excellent characteristics; high relative speed, low minimum densities and yet high maximum densities, as compared to the comparative samples prepared with Emulsions (A), (B) and (D). Even under very severe conditions, the samples of the invention are excellent in the stability that they are capable of retaining their own intrinsic nature. Further, the emulsions of the invention, even when ripened to excess, exhibit relatively stable characteristics, so that they are considered excellent in the manufacturing stability.

EXAMPLE 2

In similar manner to that of Emulsion (C) of Example 1, double shell-coated direct positive-type emulsions were prepared, provided the adding quantities of silver nitrate, sodium chloride and potassium bromide were controlled so that the silver halide compositions of the shell of the outermost layer and the proportions thereof to the whole amount of the silver halide conform to those given in Table 2. In addition, as a comparative sample, Emulsion (B) of Example 1, subjected to no shell coating on the particle surface thereof after chemical ripening, was used.

TABLE 2

| Outermost layer's silver halide composition | Proportion of the outermost layer's silver halide to the whole silver halide amount of the particle | | |
|---|---|---|---|
| | 3 (mole %) | 7 (mole %) | 20 (mole %) |
| AgCl | Emulsion (F) (Invention) | Emulsion (G) (Invention) | Emulsion (H) (Noninvention) |
| AgBr | Emulsion (I) (Invention) | Emulsion (J) (Invention) | Emulsion (K) (Noninvention) |
| AgCl.Br(1:1) | Emulsion (L) (Noninvention) | Emulsion (M) (Noninvention) | Emulsion (N) (Noninvention) |

To each of the above emulsions the following Sensitizing Dye (II) was added.

Sensitizing Dye (II)

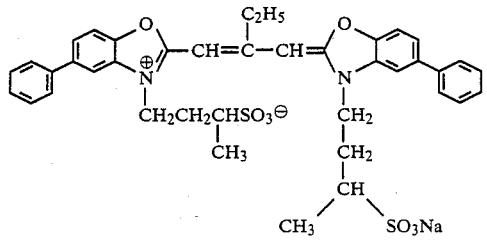

On the other hand, a magenta coupler, 1-(2,4,6-trichlorophenyl)-3-(2-chloro-5-octadecylsuccinimidoanilino)-5-pyrazolone, was dissolved into a mixture of dibutyl phthalate and ethyl acetate, and the solution was dispersed into a gelatin solution to thereby prepare a emulsified-dispersed liquid.

The emulsified-dispersed liquid was added to and mixed with each of the above emulsions, and to this were added the foregoing Hardening Agents (I) and (II). The resulting emulsions each was coated on a subbed polyester film support so that the silver coating amount is 2 g/m$^2$, and then dried. Each of these coated samples was treated under Conditions 1, 2 and 3 of Example 1.

Each of the thus treated samples was exposed to light through an wedge with a yellow filter, and then processed in the previously specified manner. The sensitometric results of these samples are as given in Table 3.

TABLE 3

| Sample No. | Emulsion | Photographic characteristics | Condition 1 | Condition 2 | Condition 3 |
|---|---|---|---|---|---|
| 6 | Emulsion (B) | Relative speed | 100 | 54 | 72 |
| | (comparative) | Maximum density | 2.02 | 2.18 | 1.85 |
| | | Minimum density | 0.26 | 0.48 | 0.32 |
| 7 | Emulsion (F) | Relative speed | 160 | 145 | 154 |
| | (Invention) | Maximum density | 2.08 | 2.12 | 1.96 |
| | | Minimum density | 0.10 | 0.18 | 0.14 |
| 8 | Emulsion (G) | Relative speed | 155 | 148 | 152 |
| | (Invention) | Maximum density | 1.98 | 2.06 | 1.92 |
| | | Minimum density | 0.09 | 0.16 | 0.13 |
| 9 | Emulsion (H) | Relative speed | 72 | 64 | 70 |
| | (Noninvention) | Maximum density | 1.47 | 1.58 | 1.45 |
| | | Minimum density | 0.07 | 0.12 | 0.09 |
| 10 | Emulsion (I) | Relative speed | 132 | 124 | 125 |
| | (Invention) | Maximum density | 1.98 | 2.00 | 1.92 |
| | | Minimum density | 0.12 | 0.18 | 0.16 |
| 11 | Emulsion (J) | Relative speed | 125 | 114 | 116 |
| | (Invention) | Maximum density | 1.88 | 1.94 | 1.86 |
| | | Minimum-density | 0.10 | 0.15 | 0.13 |
| 12 | Emulsion (K) | Relative speed | 65 | 54 | 60 |
| | (Noninvention) | Maximum density | 1.31 | 1.48 | 1.28 |
| | | Minimum density | 0.07 | 0.10 | 0.08 |
| 13 | Emulsion (L) | Relative speed | 95 | 80 | 84 |
| | (Noninvention) | Maximum density | 1.85 | 2.02 | 1.82 |
| | | Minimum density | 0.18 | 0.39 | 0.27 |
| 14 | Emulsion (M) | Relative speed | 92 | 76 | 82 |
| | (Noninvention) | Maximum density | 1.74 | 1.82 | 1.72 |
| | | Minimum density | 0.16 | 0.32 | 0.24 |
| 15 | Emulsion (N) | Relative speed | 88 | 72 | 81 |
| | (Noninvention) | Maximum density | 1.52 | 1.56 | 1.48 |
| | | Minimum density | 0.14 | 0.30 | 0.22 |

As is apparent from Table 3, the samples of the invention (Emulsions (F), (G), (I) and (J)) are remarkably improved on the minimum density as well as the stability for storage. That is, Comparative Sample 6 has a high minimum density; particularly the minimum density becomes extremely high under forced aging conditions. The sample, therefore, is not suitable for practical use. If the particle of the emulsion of this sample is coated further with a thin shell comprising a silver halide, then the minimum density as well as the stability for storage would be improved. In the samples of the AgCl.Br shell, wherein the silver halide composition of the shell is substantially not simple, their effect is significantly inferior to that of the samples whose shell comprises AgCl or AgBr alone. If the proportion of the shell increases (if the shell layer becomes thicker), although the minimum density and stability for storage are improved, the maximum density becomes lowered, thus adversely affecting the practical image formation.

The internal latent image-type silver halide photographic light-sensitive material of the present invention, which forms a direct positive photographic image, is to improve the minimum density with the maximum density remaining high, and particularly is capable of improving remarkably the minimum density so as not to be deteriorated even under forced aging conditions.

EXAMPLE 3

Each of Samples 6, 8 and 11 that were prepared in Example 2 was processed, varying the developing period of time into 2 minutes and 30 seconds, 3 minutes (standard developing time) and 3 minutes and 30 seconds. The results of the variations in the maximum and minimum densities of these samples obtained in the above developings are as given in Table 4.

TABLE 4

| Sample No. | Photographic characteristics | Developing time 2 min 30 sec | 3 min (standard) | 3 min 30 sec |
|---|---|---|---|---|
| 6 | Max. density | 1.68 | 1.96 | 2.24 |
| (Comparative) | Min. density | 0.18 | 0.26 | 0.38 |
| 8 | Max. density | 1.92 | 1.98 | 2.02 |
| (Invention) | Min. density | 0.07 | 0.09 | 0.11 |
| 11 | Max. density | 1.78 | 1.88 | 1.92 |
| (Invention) | Min. density | 0.08 | 0.10 | 0.11 |

As is obvious from Table 4, the samples of the invention (Samples 8 and 11) are excellent in the developability as compared to the comparative sample (Sample 6); that is, the variation, with changes in the developing time, of the maximum and minimum densities of the comparative sample (Sample 6) is large, while that of the maximum and minimum densities of the samples of the invention is relatively small, so that they have relatively stable characteristics.

Besides, of the samples of the invention, as the outermost layer composition, AgCl (Sample 8) has the advantage over AgBr (Sample 11) with respect to the variation of the maximum density.

EXAMPLE 4

An internal latent image-type emulsion was prepared in the following manner.

To an aqueous solution containing 20 g of gelatin, at a temperature controlled to 60° C., were added simultaneously 350 ml of an aqueous 2-mole silver nitrate solution and 350 ml of an aqueous 2.1 -mole potassium chloride solution. The mixture was physically ripened for 10 minutes, and to the mixture were then added 400 ml of an aqueous 2-mole potassium bromide solution. After that, another 10-minute physical ripening of it took place. The mixture was washed to remove the water-soluble salts therefrom, and then 20 g of gelatin were added to it. Finally water was added to make the whole 1000 ml.

To 1000 ml of this emulsion, at a temperature controlled to 60° C., were added simultaneously 200 ml of an aqueous 2-mole silver nitrate solution and 200 ml of an aqueous 2.1-mole potassium chloride solution. To this, after being subjected to 10-minute physical ripening, were added 50 ml of an aqueous 2-mole potassium bromide solution. This emulsion was washed to remove the water-soluble halide therefrom, and to this were added 20 g of gelatin, and then water to make the whole 800 ml. This was regarded as Emulsion (O).

One half of the above Emulsion (O) was taken, and to this, at a temperature controlled to 60° C., were added in the simultaneous pouring manner 33 ml of an aqueous 1.0-mole silver nitrate solution and 37 ml of an aqueous 1.0-mole sodium chloride solution, spending about 2 minutes, and then 15-minute ripening of it took place. The resulting emulsion was regarded as Emulsion (P). The silver chloride of the outermost layer accounts for 5.7 mole % of the whole silver halide particle.

To each of the above Emulsions (O) and (P) the following Sensitizing Dyes (III) and (IV) were added.

Sensitizing Dye (III)

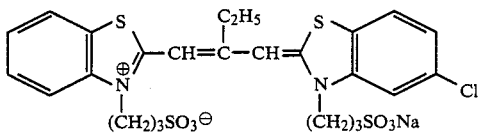

Sensitizing Dye (IV)

-continued

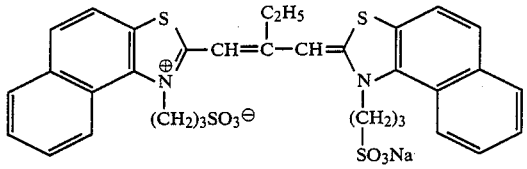

On the other hand, a cyan coupler, 2,4-dichloro-3-methyl-6-[α-(2,4-di-tert-amylphenoxy)butylamido]-phenol, was dissolved into a mixture of dibutyl phthalate and ethyl acetate, and the solution was dispersed into a gelatin solution to thereby prepare an emulsified-dispersed liquid.

Subsequently, the emulsified liquid was added to and mixed with each of the above emulsions. To this was then added the foregoing Hardening Agent (I), and the resulting emulsion was coated on a resin-coated paper support so that the silver coating amount is 0.5 g/m$^2$, and then dried. The coated samples each was treated under Conditions 1, 2 and 3 that were specified in Example 1.

These treated samples each was exposed to light through a wedge with an yellow filter, and then subjected to the foregoing development. The sensitometric results of these samples are as given in Table 5.

TABLE 5

| Sample No. | Emulsion | Photographic characteristics | Condition 1 | Condition 2 | Condition 3 |
|---|---|---|---|---|---|
| 16 | Emulsion (O) (Comparative) | Relative speed | (100) | 52 | 76 |
| | | Maximum density | 1.86 | 2.12 | 1.84 |
| | | Minimum density | 0.23 | 0.35 | 0.28 |
| 17 | Emulsion (P) (Invention) | Relative speed | 184 | 172 | 184 |
| | | Maximum density | 1.92 | 1.98 | 1.92 |
| | | Minimum density | 0.06 | 0.08 | 0.07 |

As is apparent from Table 5, even in the light-sensitive material samples which use internal latent image-type emulsions not subjected to chemical ripening, the sample prepared in accordance with this invention is more excellent in respect of the stability characteristic for storage.

EXAMPLE 5

An internal latent image-type emulsion was prepared in the following manner.

At 60° C., aqueous equimolar silver nitrate and potassium bromide solutions, while normalizing pAg, were added simultaneously to and mixed into an aqueous 2% gelatin solution, whereby a silver halide emulsion comprising regular octahedral particles of average size of 0.5 μm. To this emulsion were added 2.3 mg per mole of silver of chloroauric acid and 2.8 mg per mole of silver of sodium thiosulfate, and the emulsion was ripened for 60 minutes at 60° C. thereby to be chemically sensitized.

To this emulsion, while normalizing pAg, were added to be mixed therein aqueous equimolar silver nitrate and potassium bromide solutions to grow the silver halide up to 0.8 μm to thereby prepare a core-chemically-sensitized core/shell-type silver halide emulsion. Subsequently, to this core/shell-type silver halide emulsion were added 1.1 mg per mole of silver of chloroauric acid and 1.4 mg per mole of silver of sodium thiosulfate, and the emulsion was ripened for 40 minutes at 60° C. to thereby chemically sensitize the particle surface thereof. The resulting emulsion was regarded as Emulsion (Q).

One half of the Emulsion (Q) was taken, and subjected further to shell-coating-on-the-particle treatment in accordance with Example 1. The thus treated emulsion was regarded as Emulsion (R). The silver chloride of the outermost layer accounts for 6.6 mole % of the whole silver halide particle.

To each of the Emulsions (Q) and (R) was added the foregoing Sensitizing Dye (II), magenta coupler-dispersed liquid, and the foregoing Hardening Agents (I) and (II). This emulsion mixture was then coated on a subbed polyester film support so that the silver coating amount is 2.5 g/m$^2$, and then dried. Each of the coated samples was treated under Conditions 1, 2 and 3 specified in Example 1. Each treated sample was exposed to light through a wedge with a yellow filter, and then subjected to the following processings. The obtained results are as given in Table 6.

Processing Steps

| | | |
|---|---|---|
| Developing | at 33° C. | for 3 minutes |
| Bleach-fixing | at 30° C. | for 1 minute |
| Washing | at 20–30° C. | for 2 minutes |
| Drying | at normal temperature | for 30 minutes |

Compositions of the Processing Liquids Used

| | |
|---|---|
| Developer: | |
| 4-amino-3-methyl-N—ethyl-N—(β-methanesulfonamidoethyl)aniline sulfate | 5 g |
| Anhydrous sodium sulfite | 1 g |
| Sodium carbonate, monohydrated | 20 g |
| Hydroxylamine sulfate | 1.5 g |
| Potassium bromide | 1 g |
| 5-methyl-benzotriazolebenzyl alcohol | 10 g |
| Phenylhydrazine hydrochloride | 1.5 g |
| Water to make 1 liter. Use sodium hydroxide to adjust the pH to 13.0. | |
| Bleach-Fixer: | |
| Ferric ammonium ethylenediamine-tetracetate, trihydrated | 50 g |
| Ethylenediamine-tetracetae | 3 g |
| Ammonium thiosulfate (70% solution) | 100 ml |
| Potassium sulfite (50% solution) | 30 ml |
| Water to make 1 liter. Use potassium carbonate or acetic acid to adjust the pH to 6.9. | |

TABLE 6

| Sample No. | Emulsion | Photographic characteristics | Condition 1 | Condition 2 | Condition 3 |
|---|---|---|---|---|---|
| 18 | Emulsion (Q) (Comparative) | Relative speed | 100 | 48 | 85 |
| | | Maximum density | 1.88 | 2.04 | 1.82 |
| | | Minimum density | 0.38 | 0.62 | 0.45 |
| 19 | Emulsion (R) (Invention) | Relative speed | 156 | 136 | 142 |
| | | Maximum density | 1.94 | 2.02 | 1.94 |
| | | Minimum density | 0.09 | 0.14 | 0.10 |

As is apparent from Table 6, even in the internal-chemically-sensitized light-sensitive material samples, and further even when processed in a fogging agent-containing developer solution, the sample prepared in accordance with the present invention is more excellent in the photographic characteristics as well as in the stability characteristic for storage.

What is claimed is:

1. A direct positive silver halide photographic light-sensitive material comprising a support having thereon at least one silver halide emulsion layer containing internal latent image silver halide grains, each of said grains comprising a core/shell structured particle comprising a core, at least one intermediate layer and an outermost layer formed thereon, said outermost layer consisting essentially of silver chloride accounting for not more than 10 mole percent of the silver halide of said internal latent image silver halide grain.

2. The material of claim 1 wherein said silver chloride of said outermost layer accounts for 0.5 to 7 mole percent of said silver halide of said internal latent image silver halide grains.

3. The material of claim 1 wherein said core is converted.

4. The material of claim 1 wherein said core/shell structured particles are chemically sensitized.

5. The material of claim 4 wherein said particles are sulfur sensitized.

6. A method for producing internal image type photographic silver halide grains, said method comprising forming a silver halide outermost layer on core/shell structured silver halide particles wherein said layer consists essentially of silver chloride which accounts for not more than 10 mole percent of the total mole percent of the silver halide of said internal latent image type photographic silver halide grains.

7. The method of claim 6 wherein said outermost layer consists essentially of silver chloride composition which accounts for 0.5 to 7 mole percent of said silver halide grains.

8. The method of claim 6 wherein said core is converted.

9. The method of claim 6 wherein said core/shell structured silver halide particles are chemically sensitized.

10. The method of claim 9 wherein said core/shell structured silver halide particles are chemically sensitized by a sulfur sensitizer.

11. A method of forming a direct positive image which comprises imagewise exposing a silver halide photographic light-sensitive material, and subjecting said exposed silver halide photographic light-sensitive material to surface development after or during fogging treatment, said silver halide photographic light-sensitive material comprising a support having thereon at least one silver halide emulsion layer containing internal latent image silver halide grains, each of said grains comprising a core/shell structured particle comprising a core, at least one intermediate layer, and an outermost layer formed thereon, said outermost layer consisting essentially of silver chloride which accounts for no more than 10 mole percent of the total mole amount of silver halide of said internal latent image silver halide grains.

12. The method of claim 11 wherein said outermost layer consists essentially of silver chloride content which accounts for 0.5 to 7 mole percent of the total mole amount of the silver halide of said internal latent image silver halide grains.

* * * * *